United States Patent [19]

Meister et al.

[11] Patent Number: 4,460,881

[45] Date of Patent: Jul. 17, 1984

[54] QUIET RELAY

[76] Inventors: Jack B. Meister, 68 Chimney Ridge, Convent Station, N.J. 07961; Stephen P. Beard, R.D. 4, Box 43, Newton, N.J. 07860; Robert H. Andrews, 131 Bound Brook Rd., Parsippany, N.J. 07054

[21] Appl. No.: 429,141

[22] Filed: Sep. 30, 1982

[51] Int. Cl.[3] ..... H01H 51/08

[52] U.S. Cl. ..... 335/128; 335/193; 335/196

[58] Field of Search ..... 335/128, 187, 193, 194, 335/271, 277, 275, 200; 200/241, 246, 252, 257

[56] References Cited

U.S. PATENT DOCUMENTS

| | | | |
|---|---|---|---|
| 2,292,497 | 8/1942 | Vranderburgh | 335/200 |
| 3,164,758 | 1/1965 | Siefert | 335/271 |
| 4,003,011 | 1/1977 | Hayden | 335/196 |
| 4,236,132 | 11/1980 | Zissimopoulos | 335/193 |
| 4,376,895 | 3/1983 | Meister | 335/186 |

FOREIGN PATENT DOCUMENTS

| | | | |
|---|---|---|---|
| 154575 | 12/1920 | United Kingdom | 335/128 |

*Primary Examiner*—J. D. Miller
*Assistant Examiner*—J. Sterrett
*Attorney, Agent, or Firm*—H. Hume Mathews; Ronald G. Goebel

[57] ABSTRACT

An electro-mechanical relay, particularly for automotive use, characterized by quietness of operation in which the armature coil, spring arm and contact elements are so arranged that the mating surfaces of the contact elements lie substantially in a single plane when in open position and are closed without audible noise by relative sliding movement in said plane.

3 Claims, 3 Drawing Figures

QUIET RELAY

BACKGROUND OF THE INVENTION

The invention relates to electrical relays, and particularly to direct current relays for automotive use.

It is known in the prior art (see, for example, U.S. Pat. Nos. 4,003,011 and 4,064,470) that it is desirable that some of the electrical relays used in automobiles or other vehicles should operate quietly, without audible sound when activated. There is a need for electromechanical relays which operate as quietly as possible so as not to be disturbing to the operator of the vehicle or for other reasons. It is also necessary, in view of the nature of the automotive market, that such relays, like other electromechanical components of automobiles, be reliable in operation, inexpensive to manufacture and small in size.

BRIEF SUMMARY OF THE INVENTION

According to the present invention, an electromechanical relay is provided, particularly for automotive use, which has a frame, coil and armature relationship very similar to that of a conventional automatic relay in arrangement and construction. However, in the relay of the present invention the movable relay spring arm, fixed at one end to the armature and having the movable contact on its free end, is bent at a generally right angle to the relay armature so that it moves in a plane generally parallel to the axis of the coil when the coil is energized and attracts the armature. The fixed relay contact is similarly disposed, on a spring arm fixed to the base of the relay and which lies in a plane spaced from and parallel to said first plane. The two contacts and their respective supporting spring arms are so arranged that when they move into or out of contact, or electrical engagement, they move relatively in said parallel planes and thus "slide" into contact, as distinct from a hammer blow type contact such as occurs in conventional relays in which the closing movement is in a direction perpendicular to the faces of the contacts, rather than parallel thereto.

The sideways or "tangential" closing movement of the contacts of the relay of the present invention create no appreciable audible sound when the contacts meet, and thus the undesirable noise that results from the contacts closing in a perpendicular orientation, as is customary in conventional relays, is eliminated.

Yet the relay of the present invention at the same time offers the advantages of reliability, low manufacturing cost, and small size, all necessary to meet the needs of the automotive market.

Other sources of noise are also eliminated by the relay of the present invention. The armature is so positioned that it is always in contact with the relay frame, and thus can never strike it and create noise when the relay is opened or closed. In addition, a rubber member is fastened to the armature between the armature and the metal core of the electromagnetic coil so that there can be no metal to metal contact (with resultant noise) when the armature is attracted to the core. This rubber member preferably extends around and over the top of the armature so that on return, or opening of the armature, it cushions or dampens the vibrations of the spring arm that carries the moving contact, thereby eliminating noise from that source. The rubber sound deadening element also facilitates adjustment of the relay, because it has a portion lying between the armature and the coil core, thus making it unnecessary to try to adjust the relay at an exact spacing from the core so that it will not strike the core with a noise creating contact.

DETAILED DESCRIPTION OF THE DRAWINGS

Figure 1:
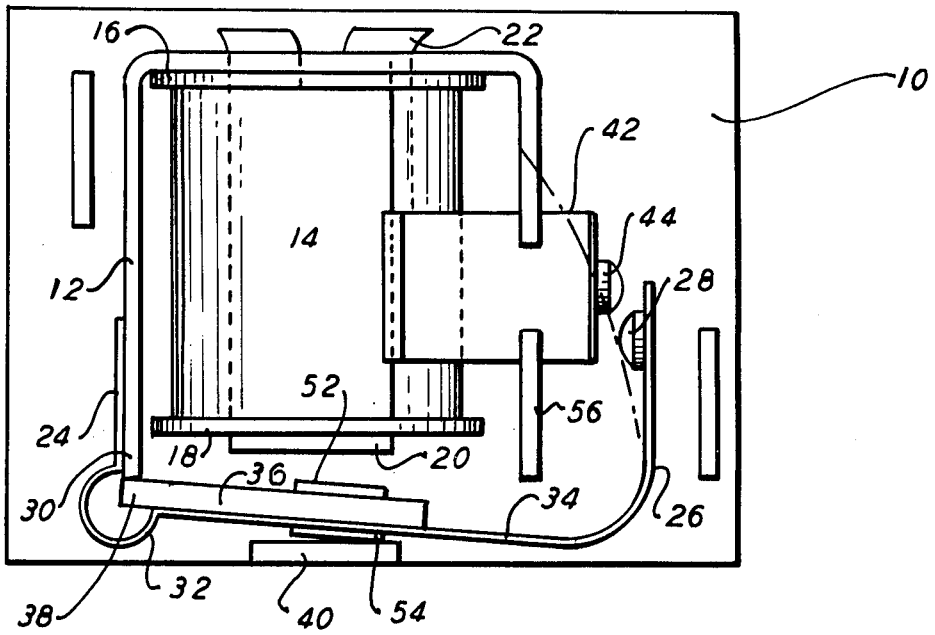
FIG. 1 is a plan view of a relay constructed in accordance with the invention, with the relay contacts in open position.

FIG. 1 shows a relay comprising a base having mounted thereon by rivets (not shown) a frame 12. An electrical coil 14 wound between end supports 16, 18 and having a magnetic metal core 20 is supported on frame 12 by riveted fingers 22, so as to be immovably fixed thereto.

Figure 2:
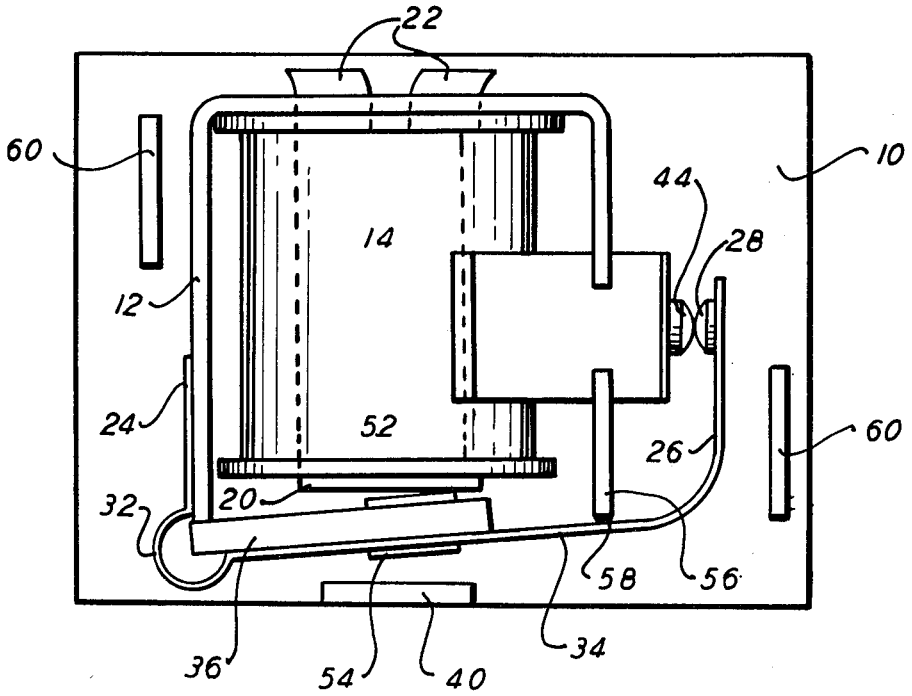
FIG. 2 is a plan view like FIG. 1, but with the relay energized and the armature closed, so that the contacts are in closed position.

The left hand leg of frame 12 (as it appears in FIGS. 1 and 2) carries a spring arm 24 soldered thereto which extends around the end of the frame, across the lower end of the coil and then is bent at a right angle so that its free end 26 lies in a plane generally parallel to the axis of the coil. The free end of the spring arm has fixed thereto the movable contact 28.

At the point where spring arm 24 passes around the end 30 of frame 12, it is bent outwardly in a three quarter circle to allow flexing of the spring arm so that its straight portion 34 can move toward coil 14 when the magnetic field created by coil 14 attracts the magnetic armature 36 bonded to the spring arm for movement therewith. The spring arm is of a copper alloy that is not only conductive but also acts like a leaf spring, biasing the armature 36 in a direction away from pole piece 20 so that when the current through the coil is interrupted and the magnetic field created by the coil collapses, the spring arm 34, with the cylindrical portion 32 thereof acting like a compressed spring coil, will expand in diameter and cause the straight portion 34 of the spring arm and the armature 36 bonded thereto to snap away from the pole piece 20.

The left hand edge portion 38 of armature 36 rests on the end portion 30 of frame 12, and is held in this position by the configuration of the partially circular segment 32, the ends of which are spaced apart by a distance approximately the thickness of armature 36. Thus, armature 36 which is bonded to the spring arm section 34 is held by the spring arm in contact with the frame at the heel gap. Its left hand end 38 always contacts the lower end 30 of frame 12. The armature and spring arm assembly, as previously stated, is fixed to frame 12 by the bonding of the vertical left hand section 24 of the spring arm to the underlying portion of the frame. It is to be understood that the use of "up", "down", "left", "right", "vertical" or "horizontal" in this description is for descriptive purposes only, and not in any limiting sense. In practice, the relay of this invention can be operated in any orientation, and the relative position of its components may be reversed or otherwise changed as may be desirable for differing applications.

In the "off" or non-energized position of the relay (FIG. 1), in which no current flows through coil 14, the coiled portion 32 of the spring arm bias it to its open position in which the armature 36 is biased downwardly against the stop 40 (FIG. 1) by the spring arm 34. In that position, movable contact 28 has moved downwardly along its arc of movement indicated at 42 to the open position shown in FIG. 1 in which movable contact 28 is separated from the fixed contact of the relay, indicated at 44 so that there is a gap between the two contacts with the result that no current can pass therebetween.

Figure 3:
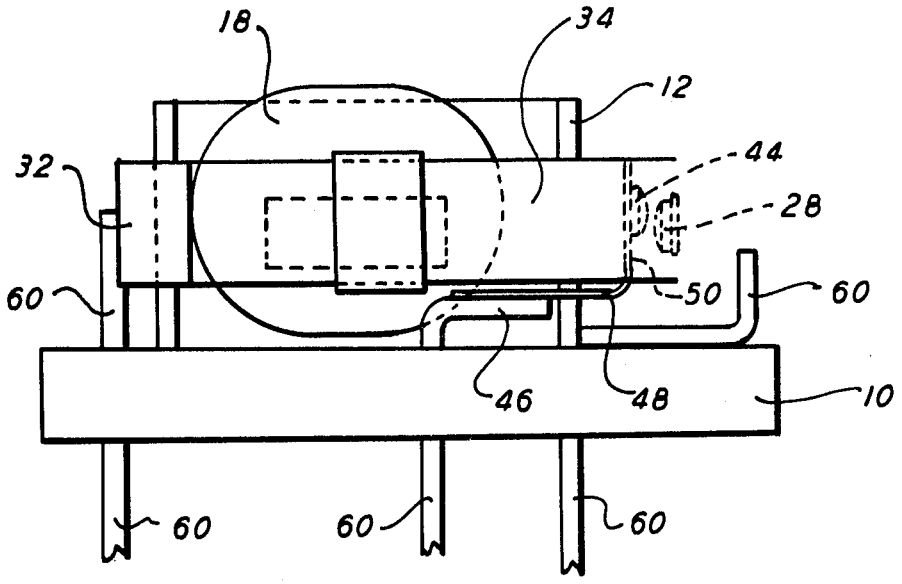
FIG. 3 is a partial side view of the relay of FIGS. 1 and 2.

Fixed contact 44 is carried by a bracket 46 (FIG. 3) having a horizontal section soldered or otherwise bonded to a horizontal section of a flexible copper alloy spring strip 48. The spring strip 48 has a vertical section 50 carrying the fixed contact 44. Thus, the fixed contact 44, like the movable contact 28, are both carried on flexible, current conducting spring arms, so that as they slide into contact by movement of contact 28 along path 42 when the coil is energized, the contacts will smoothly slide into a current carrying junction and be held there by the compressive force of the two spring arms, specifically by the leaf spring action of section 26 of arm 34 and section 50 of arm 48.

Closing movement of armature 36 (FIG. 2) is limited by the contact of a rubber sound deadening material 52, laminated to the upper side of armature 36, against pole piece 20. Similarly, a sound deadening lamination of material 54 on the underside of armature 36 limits the opening movement of armature 36 when it contacts a lower stop 40 (FIG. 1), mounded on base 10.

As a means for ensuring exact alignment of the fixed and movable contacts 28, 44 when they are in closed, conducting, position, frame 12 may be provided with an extension 56 so positioned as to provide a stop 58 (FIG. 2) beyond which the arm section 34 cannot go, thus ensuring against a possible override of contact 28 beyond its proper contact point with the fixed contact 44.

Current may be passed, in the usual way, to and from coil 14 and contacts 28, 44 through terminals 60. A cover (not shown) may be provided for the operating mechanism.

The above described novel combination of components has been found to provide an electro-mechanical relay of very low mass in all movable parts, which in operation has a level of quietness not to our knowledge hitherto accomplished, in a package which is smaller than previously existing packages, less expensive to manufacture, and highly reliable in operation over long periods of use.

We claim:

1. An electro-mechanical relay characterized by quiet operation comprising:

a coil containing a pole piece for creating a magnetic field in response to a flow of electrical current through said coil;

an armature of magnetic material extending transversely with respect to the axis of said coil across said pole piece;

a spring arm secured to said armature having a fixed end and a free end which is movable with respect to said fixed end in response to movements of said armature toward or away from said pole piece;

said free end of said spring arm being bent at a generally right angle to the relay armature adjacent its free end so that the free end has an end section extending in the direction of the coil axis which moves in a plane generally parallel to the axis of the coil when the coil is energized and attracts the armature, said free end having an electrical contact element thereon which is moved in response to movements of said armature in a path which is generally parallel to the axis of said coil, and a fixed electrical contact element positioned adjacent said movable contact element for sliding engagement with said movable contact along mating surfaces which lie in a plane generally parallel to the axis of said coil.

2. A relay according to claim 1, in which means are provided for preventing said armature, in its movements toward and away from said pole piece, from striking either said pole piece or the frame which supports said coil.

3. A relay according to claim 1, in which said spring arm is secured to said armature at a location intermediate the ends of said spring arm and which is spaced from said free end of said arm.

* * * * *